United States Patent [19]

Winkler

[11] Patent Number: 5,031,896

[45] Date of Patent: Jul. 16, 1991

[54] SHEET DETECTOR

[75] Inventor: Theodore Winkler, Levittown, Pa.

[73] Assignee: Brandt, Inc., Bensalem, Pa.

[21] Appl. No.: 466,520

[22] Filed: Jan. 17, 1990

[51] Int. Cl.[5] ..... B65H 7/00

[52] U.S. Cl. ..... 271/258; 271/265; 271/272; 271/121; 271/10

[58] Field of Search ..... 271/263, 262, 258, 265, 271/272, 10, 110, 119, 121; 194/206

[56] References Cited

U.S. PATENT DOCUMENTS

| | | | |
|---|---|---|---|
| 4,641,949 | 2/1987 | Wallace et al. | 271/258 X |
| 4,849,915 | 7/1989 | Worsley et al. | 271/258 X |
| 4,944,505 | 7/1990 | Sherman | 271/265 |

FOREIGN PATENT DOCUMENTS

| | | | |
|---|---|---|---|
| 118547 | 6/1985 | Japan | 271/258 |

*Primary Examiner*—David H. Bollinger
*Attorney, Agent, or Firm*—Shenier & O'Connor

[57] ABSTRACT

A sheet detector comprises a pair of rollers disposed on opposite sides of a feed path, each roller having a conductive outer portion extending therearound. The conductive portions, which are supported on the roller shafts by electrically insulating, relatively yieldable cores, contact each other to establish an electrical connection in the absence of a sheet therebetween and are separated from each other during the passage of a sheet therebetween to break the connection and thereby indicate the presence of the sheet. Conductive brushes resiliently biased into circumferential grooves formed on the conductive portions couple the portions to an external circuit including a sheet counter and a length counter.

9 Claims, 3 Drawing Sheets

SHEET DETECTOR

BACKGROUND OF THE INVENTION

This invention relates to apparatus for detecting the presence of sheets at a predetermined location along the feed path of a document counter, endorser or the like.

Often it is desirable to have a signal indicating the presence of a sheet at a predetermined location along a feed path. Such a sheet signal may be used for counting, length measurement, jam detection and the like.

Various methods of sheet detection have been used, each having its own particular drawbacks. Mechanical sensors using fingers have the disadvantage that the fingers may interfere with the movement of the sheet, especially if the sheet is thin or has become worn.

Optical methods are also commonly used. One common expedient is to direct a light beam across the sheet feed path to a detector so that the beam is interrupted during the passage of the sheet. Another expedient is to sense a beam of light reflected back from the sheet. Although these methods do not interfere with sheet movement, they depend on the opacity or reflectance of the sheets for the production of a sheet signal, so as to be unreliable if these optical properties of the sheets are atypical. Thus, certain documents may be of a color that does not reflect light of the incident wavelength, and thus fail to be detected by a reflectance measurement. Other documents may be so thin as to miss being detected by an opacity measurement. Both of these techniques are also susceptible to error if the documents in question contain holes. If the portion of the document being scanned contains a hole, it will generally be interpreted as two separate documents.

SUMMARY OF THE INVENTION

One object of my invention is to provide a sheet detector that reliably senses the presence of sheets at a predetermined location along a path.

Another object of my invention is to provide a sheet detector that does not interfere with the movement of the sheet being detected.

Still another object of my invention is to provide a sheet detector which is color blind.

Yet another object of my invention is to provide a sheet detector for detecting transparent sheets.

A further object of my invention is to provide a sheet detector that operates reliably with sheets containing holes.

Other and further objects will be apparent from the following description.

In general, my invention contemplates apparatus for detecting the presence of a sheet along a path in which each of a pair of rotary feed members disposed on opposite sides of the path has a conductive outer peripheral portion. The conductive portions contact each other to establish an electrical connection in the absence of a sheet therebetween and are insulated from each other during the passage of a sheet therebetween to indicate the presence of the sheet.

Preferably, at least one of the rotary members includes an electrically insulating portion of yieldable material supporting the conductive portion of the member to ensure reliable contact between the conductive portions in the absence of a sheet while at the same permitting the conductive portions to separate slightly to accommodate the passage of a sheet. Preferably, the conductive portions are coupled to the external circuit through conductive brushes that are resiliently biased into circumferential grooves formed on the peripheries of the conductive portions. The external circuit may include a sheet counter, a length register or the like, in the manner of sheet detectors of the prior art.

Since my sheet detector does not rely on mechanical feelers or on the optical properties of the sheet being sensed, it avoids the defects of mechanical and optical sensors of the prior art. Further, any holes in the sheets would have to be in line with the rotary members and large enough to permit contact between the conductive portions to result in a single sheet being misread as two separate sheets. Since most holes are much smaller than this, my sheet detector is substantially insensitive to such a source of error.

BRIEF DESCRIPTION OF THE DRAWINGS

In the accompanying drawings to which reference is made in the instant specification and which are to be read in conjunction therewith and in which like reference numerals are used to indicate like parts in the various views.

DESCRIPTION OF THE PREFERRED EMBODIMENT

Figure 1:
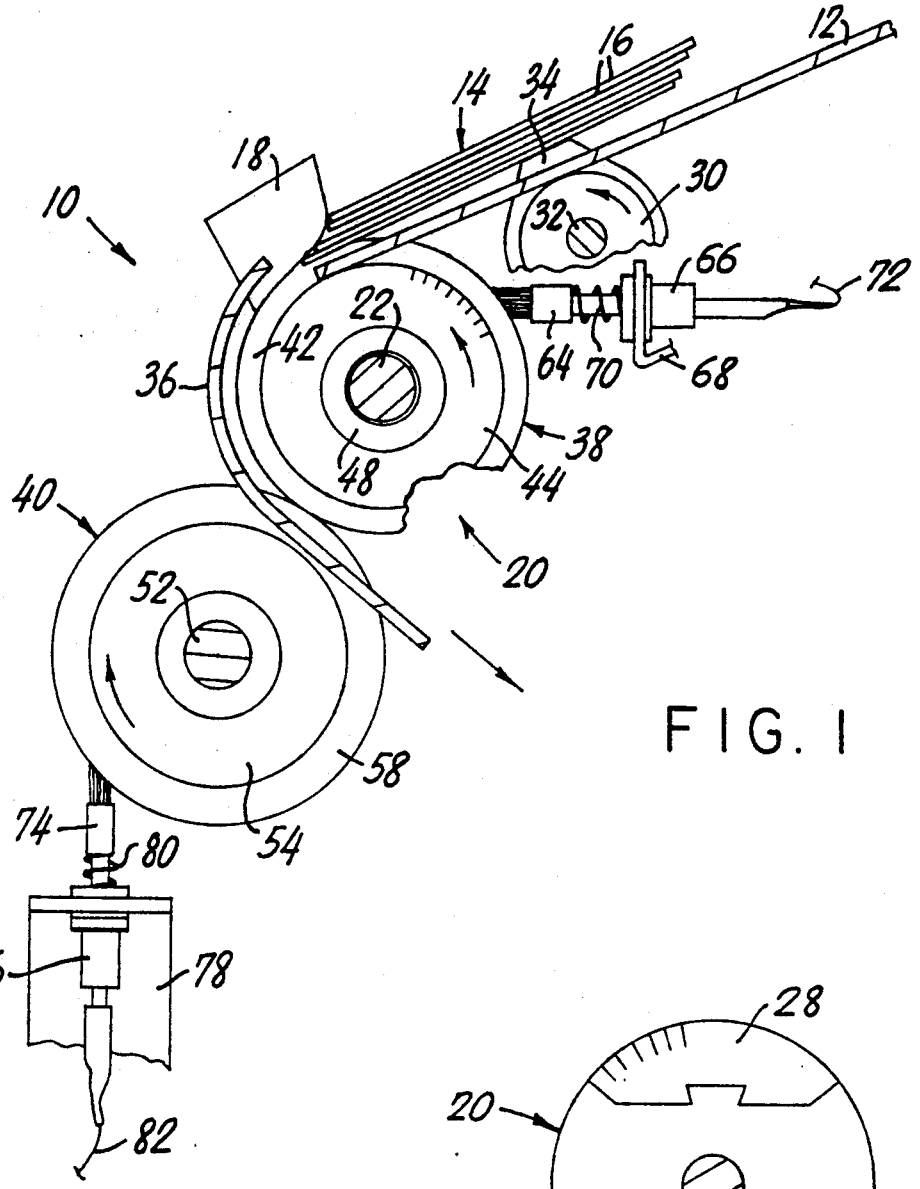
FIG. 1 is a fragmentary left side elevation of a document feeder incorporating my sheet detector, with parts broken away or shown in section.
Figure 3:
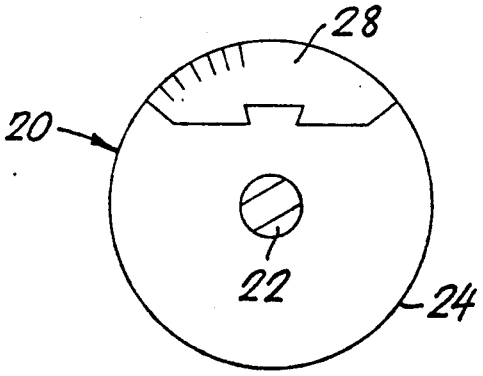
FIG. 3 is a left side elevation of one of the feed rollers of the feeder shown in FIG. 1.
Figure 4:
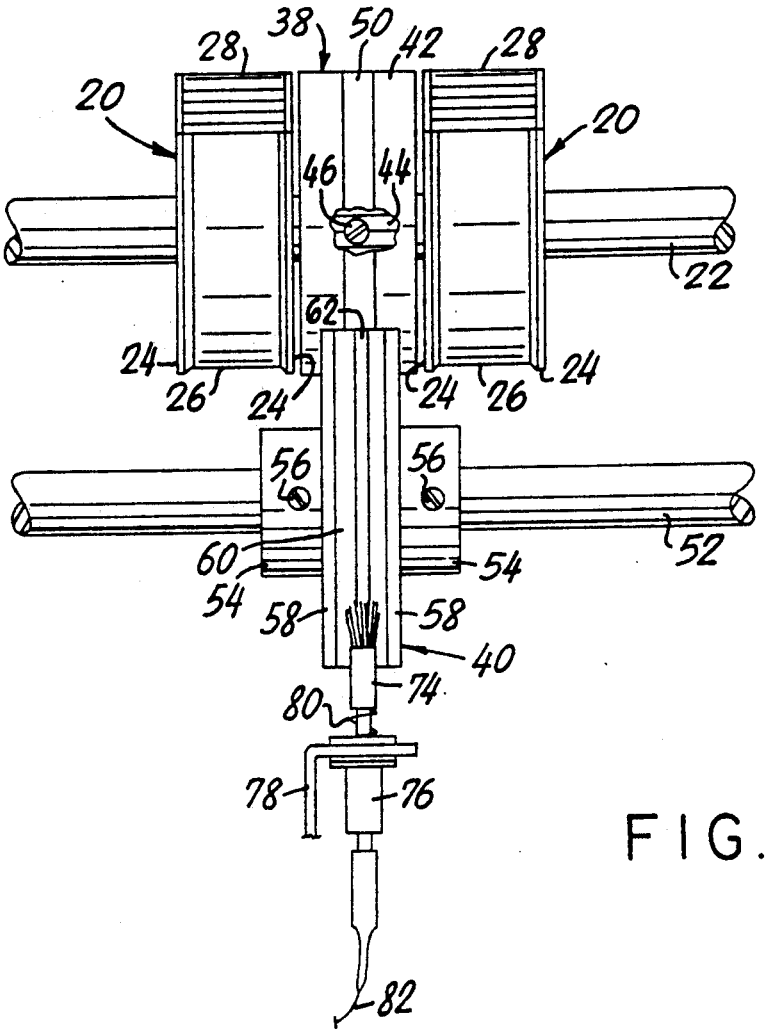
FIG. 4 is a fragmentary rear elevation of the sheet feeder shown in FIG. 1.

Referring to FIGS. 1 and 4, a sheet feeder 10 incorporating my sheet detector includes a support 12 for receiving a stack 14 of sheets 16 such as checks, food stamps, currency or the like. Support 12 is inclined upwardly toward the front of the feeder, shown on the right in FIG. 1, to bias the stack 14 of sheets 16 into the nip formed by a pair of transversely spaced feed rollers 20 supported on a shaft 22 for rotation therewith and respective stripper shoes 18 disposed opposite feed rollers 20. A suitable source (not shown) drives shaft at a velocity of about 1000 rpm. Referring now also to FIG. 3, each of feed rollers 20 has a central annular recess 26 formed by end flanges 24 into which the associated stripper shoe 18 extends. Feed rollers 20 generally comprise a low-friction material, but are provided with high-friction inserts 28 over a portion of their periphery as shown in FIG. 3.

Stripper shoes 18 comprise a material having a coefficient of friction greater than that of the major circumferential portion of feed rollers 20 but less than that of the high-friction inserts 28. As a result, sheets 16 are normally restrained from passing through the nip formed by stripper shoes 18 and feed rollers 20, but are periodically fed through the nip, one at a time, from the bottom of the stack 14 as the high-friction inserts 28 rotate past stripper shoes 18. To assist in the separation of the lowermost sheet 16 from the stack 14, the feeder 10 also has a pair of transversely spaced picker rollers 30 carried by a shaft 32 driven synchronously with feed roller shaft 22. Each picker roller 30 carries a high-friction lobe 34 that periodically extends upwardly through a slot (not shown) in support 12 to drive the lower sheet into the feed nip formed by feed rollers 20 and stripper shoes 18.

Upon passing through the feed nip formed by rollers 20 and shoes 18, each sheet 16 is directed by a lower guide 36 about the peripheries of feed rollers 20 and through a downstream nip formed by an idler roller 38 and accelerator roller 40. Idler roller 38 is rotatably supported by shaft 22 between feed rollers 20, while accelerator roller 40 is supported by a shaft 52 disposed beneath lower guide 36 for rotation therewith. Shaft 52 is driven at a greater angular velocity (e.g., 1300 rpm) than feed roller shaft 52 so that rollers 38 and 40 accelerate sheets as they enter the lower nip.

Figure 2:
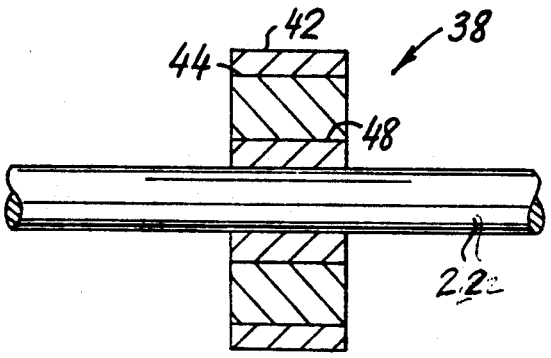
FIG. 2 is a section of the idler roller of the sheet feeder shown in FIG. 1.

Referring now to FIG. 2, idler roller 38 comprises an outer ring 42, formed of a suitable conductive material such as steel, carried by an intermediate core 44 of insulating, relatively yieldable (e.g., 35 durometer) material such as noncellular polyurethane. A set screw 46 (FIG. 4) fixes core 44 onto a metal hub 48 that is free to rotate relative to feed roller shaft 22. Referring to FIG. 4, outer ring 42 has its outer periphery formed with a relatively shallow (e.g., 0.020 inch) circumferentially extending groove 50 (not shown in FIG. 2), having a radius slightly less than that of the adjacent portions of ring 42, for a purpose to be described.

Figure 5:
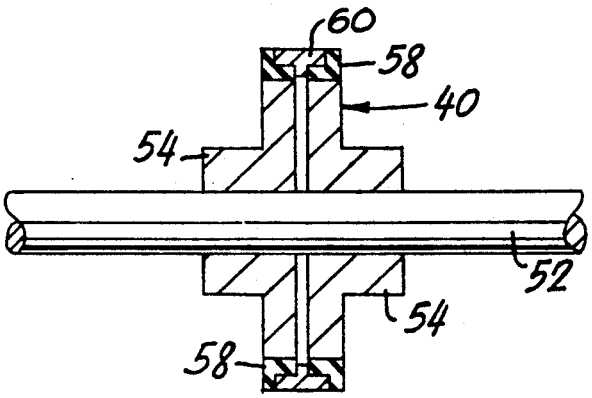
FIG. 5 is a section of the accelerator roller of the feeder shown in FIG. 1.
Figure 6:
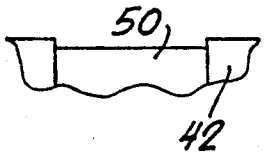
FIG. 6 is an enlarged fragmentary front elevation of the idler roller of the feeder shown in FIG. 1.
Figure 7:
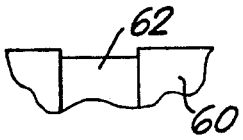
FIG. 7 is a fragmentary front elevation of the accelerator roller of the feeder shown in FIG. 1.

Referring now to FIG. 5, accelerator roller 40 comprises a pair of hubs 54 which are fixed on shaft 52 by any suitable means such as set screws 56 (FIG. 4) or the like. Hubs 54, which preferably comprise metal, have adjacent flanges, each of which supports an insulating tire 58 having a generally L-shaped cross-section as shown in FIG. 5 and formed of a relative yieldable material such as rubber or polyurethane. Tires 58 in turn support a conductive outer ring 60, having a T-shaped cross-section as shown in FIG. 5 so as to mate with the adjacent surfaces of tires 58. In a manner similar to that of ring 42 of idler roller 38, ring 60 of accelerator roller 40 is provided with a circumferentially extending groove 62 (not shown in FIG. 5) on its outer periphery for a purpose to be described.

A first conductive brush 64 is slidably received by an insulating support 66 supported by a bracket 68 coupled to the frame (not shown) of the feeder 10. A spring 70 urges brush 64 into the groove 50 of idler roller 38. In a similar manner, a second conductive brush 74 is slidably received by an insulating support 76 carried by a bracket 78. A spring 80 biases brush 74 into the groove 62 of ring 60 as shown in FIGS. 1 and 4. Grooves 50 and 62 facilitate self-cleaning since they contact only brushes 64 and 74 and remain out of contact with the sheets 16 as they pass through the nip. Respective output lines 72 and 82 from brushes 64 and 74 supply inputs to the counter circuit to be described.

Shafts 22 and 52 are so spaced from each other that resilient portions 44 and 58 of rollers 38 and 40 urge conductive rings 42 and 60 into contact with each other to establish an electrical connection in the absence of a sheet therebetween.

Figure 8:
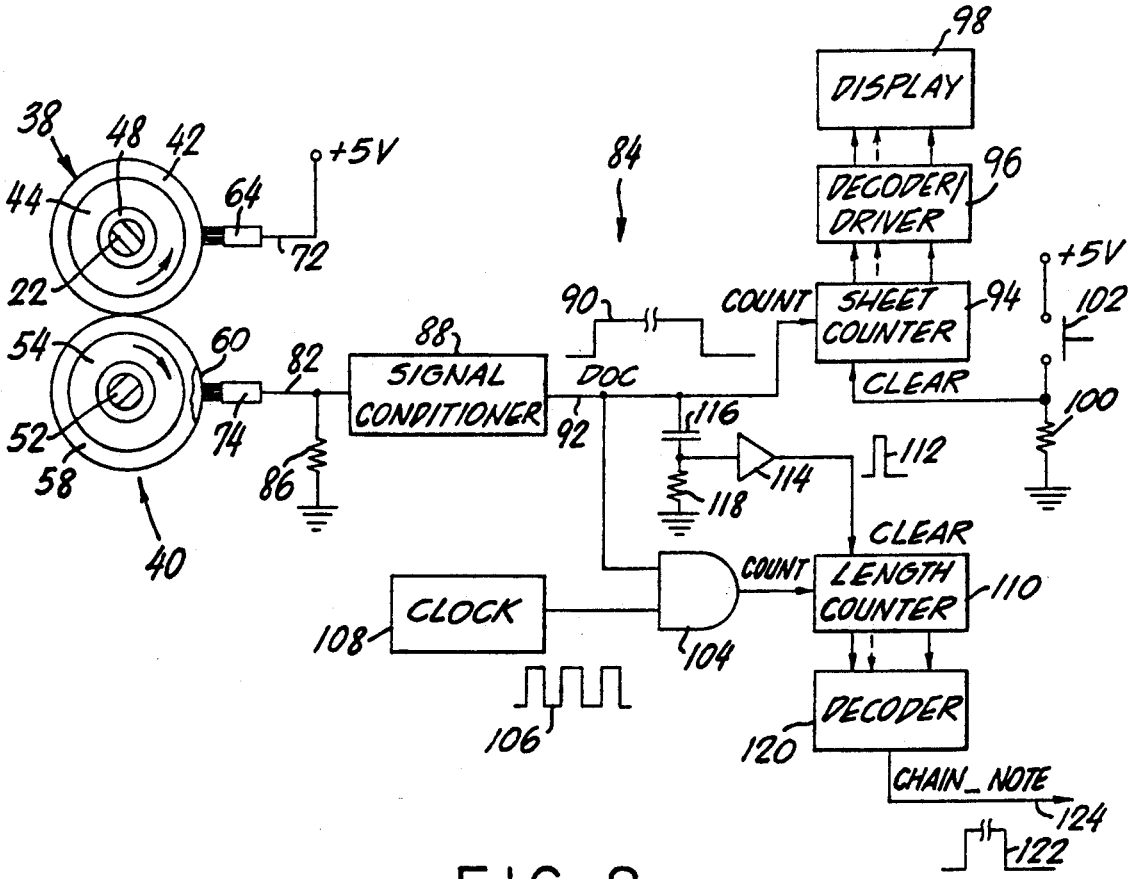
FIG. 8 is a schematic diagram of the electronic portion of the sheet detector of the feeder shown in FIG. 1.

FIG. 8 shows an exemplary circuit 84 that may be used in conjunction with rollers 38 and 40. In circuit 84, line 72 from brush 64 is coupled to a 5 volt DC supply, while line 82 from brush 74 is coupled to ground through a resistor 86 as well as to the input of a suitable signal-conditioning circuit 88. Line 82 from brush 74 normally carries a high potential, but drops to a low potential in response to the passage of an insulating sheet 16 between conductive portions 42 and 60 of rollers 38 and 40, breaking the electrical connection therebetween. Signal conditioner 88, responsive to line 82, normally provides a low-level output on a DOC line 92, but provides a high level DOC signal 90 during the passage of a sheet 16 between rollers 38 and 40. This DOC signal on line 92 supplies the count input to a suitable sheet counter 94, the output of which is coupled to a display 98 through a decoder/driver 96. A resister 100 coupled to ground normally supplies the CLEAR input to counter 94 with low-level signal. Momentary closure of a reset switch 102 couples the clear input of counter 94 to the 5 volt line to clear the count.

The DOC signal 90 on line 92 also provides one input to an AND gate 104, the other input of which is derived from a clock pulse generator 108, which supplies a pulse train 106. Pulse generator 108 may comprise either a fixed frequency source such as a quartz crystal or, preferably, an encoding wheel rotating synchronously with one of the drive members of feeder 10 such as shaft 52. AND gate 104 drives the count input of a length counter 110, which also receives a clear signal 112 from a noninverting buffer 114. Buffer 114 has its input coupled to line 92 through a capacitor 106 and to ground through a resistor 118. Buffer 114 responds to the positive-going transition of DOC signal 90 produced upon the arrival of a sheet 16 at rollers 38 and 40 to provide a positive pulse 112 to the clear input of counter 110. Counter 110 thus stores a signal denoting the count, in clock pulses 106, since the leading edge of the document 16 passing between rollers 38 and 40. A decoder 120 responsive to the output from counter 110 provides CHAIN_NOTE signal 122 on line 124 whenever the count stored in the counter 110 reaches a pre-determined value, indicating an overly long sheet 16 or, as it is commonly called, a chain note.

It will be seen that I have accomplished the objects of my invention. My sheet detector reliably senses the presence of sheet at a predetermined location along a feed path. Further, it does not interfere with the movement of the sheet being detected, nor does it rely on sheets having certain typical opacities or reflectances. It is color blind and can count transparent sheets. Further, my sheet detector is relatively immune from errors due to holes.

It will be understood that certain features and subcombinations are of utility and may be employed without reference to other features and combinations. This is contemplated by and within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for detecting the presence of a sheet of insulating material including in combination a pair of rollers forming a nip through which a sheet is adapted to pass, each of said rollers having a periphery with an electrically conductive portion, means mounting said rollers for rotary movement so that said peripheral portions register in the course of rotation of the rollers, a first brush for contacting the conductive portion of one of said rollers, a second brush for contacting the conductive portion of the other roller, means connecting said brushes in an external circuit which is complete when said portions register in the absence of a sheet in said nip and which is open when said portions register with a sheet in said nip, and means responsive to an open circuit with said portions in register for indicating the presence of a sheet.

2. Apparatus as in claim 1 in which ease of said conductive portions extends entirely around the periphery of its associated roller.

3. Apparatus as in claim 1 in which at least one of said rollers includes a relatively yieldable portion supporting the conductive portion of said roller.

4. Apparatus as in claim 1 including means coupled to said conductive portions for generating a first electrical signal indicating the absence of a sheet between said rollers and for generating a second electrical signal indicating the presence of a sheet between said rollers.

5. Apparatus as in claim 4 in which said generating means generates a pulse train having a first level in the absence of a sheet between said rollers and having a second level during the presence of a sheet between said rollers.

6. Apparatus as in claim 5 including means for counting the pulses in said train.

7. Apparatus as in claim 5 including means for measuring the duration of the pulses in said train.

8. Apparatus for detecting the presence of a sheet of insulating material moving along a path including in combination a pair of rollers disposed on opposite sides of said path, each of said rollers having a conductive outer portion extending therearound, said conductive portions contacting each other to establish an electrical connection therebetween in the absence of a sheet therebetween and being insulated from each other during the passage of a sheet therebetween to break said connection and thereby indicate the presence of said sheet, a conductive brush, means for positioning said brush in contact with the conductive portion of one of said rollers, said conductive portion of said one roller being formed with a circumferentially extending groove, said brush extending into said groove.

9. In a sheet feeder and counter apparatus including in combination a first shaft, first and second feed rollers mounted in spaced relationship on said first shaft, a third roller carried by said first shaft in the space between said first and second feed rollers, a second shaft, a fourth roller carried by said second shaft, said third and fourth rollers forming a nip through which a sheet is adapted to pass, each of said third and fourth rollers having a periphery with an electrically conductive portion, means mounting said first and second shafts so that said peripheral portions register in the course of rotation of the shafts, a first brush for contacting the conductive portion of one of the third and fourth rollers, a second brush for contacting the conductive portion of the other of the third and fourth rollers, means connecting said brushes in an external circuit which is complete when said portions register in the absence of a sheet in said nip and which is open when said portions register with a sheet in said nip, and means responsive to an open circuit with said portions in register for indicating the presence of a sheet.

* * * * *

UNITED STATES PATENT AND TRADEMARK OFFICE

CERTIFICATE OF CORRECTION

PATENT NO. : 5,031,896

DATED : July 16, 1991

INVENTOR(S) : Theodore Winkler

It is certified that error appears in the above-identified patent and that said Letters Patent is hereby corrected as shown below:

Column 5:

Claim 2, line 1, change "ease" to --each--.

Signed and Sealed this

Thirteenth Day of October, 1992

*Attest:*

DOUGLAS B. COMER

*Attesting Officer*

*Acting Commissioner of Patents and Trademarks*